US007538286B2

(12) United States Patent
Yoshioka

(10) Patent No.: US 7,538,286 B2
(45) Date of Patent: May 26, 2009

(54) KEY SHEET AND PUSHBUTTON SWITCH

(75) Inventor: Toshikazu Yoshioka, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 202 days.

(21) Appl. No.: 11/822,055

(22) Filed: Jul. 2, 2007

(65) Prior Publication Data

US 2008/0000767 A1 Jan. 3, 2008

(30) Foreign Application Priority Data

Jul. 3, 2006 (JP) ..... 2006-183558

(51) Int. Cl.
*H01H 13/70* (2006.01)

(52) U.S. Cl. ..... 200/341; 200/5 A

(58) Field of Classification Search ..... 200/5 A, 200/341, 511, 512; 341/22, 34; 345/168, 345/169; 29/622
See application file for complete search history.

(56) References Cited

U.S. PATENT DOCUMENTS

| | | | | |
|---|---|---|---|---|
| 6,967,292 | B2 * | 11/2005 | Nishimura | 200/5 A |
| 7,034,235 | B2 * | 4/2006 | Hosaka | 200/314 |
| 7,262,379 | B2 * | 8/2007 | Nishimura et al. | 200/314 |
| 7,348,512 | B2 * | 3/2008 | Iohara | 200/341 |
| 7,358,454 | B2 * | 4/2008 | Senzui | 200/341 |
| 7,361,859 | B2 * | 4/2008 | Yoshioka et al. | 200/341 |
| 7,378,607 | B2 * | 5/2008 | Koyano et al. | 200/341 |
| 7,485,822 | B2 * | 2/2009 | Koyano et al. | 200/341 |
| 2003/0213683 | A1 | 11/2003 | Shimizu et al. | |

FOREIGN PATENT DOCUMENTS

| | | | |
|---|---|---|---|
| EP | 1 320 114 | A3 | 8/2002 |
| EP | 1 265 261 | A2 | 12/2002 |
| EP | 1 265 261 | A3 | 4/2003 |
| EP | 1 320 114 | A2 | 6/2003 |
| JP | 2004-319396 | A | 11/2004 |

OTHER PUBLICATIONS

Communication from European Patent Office for application No. 07012468.0-2214 dated Oct. 30, 2007.

* cited by examiner

*Primary Examiner*—Michael A Friedhofer
(74) *Attorney, Agent, or Firm*—Cermak Kenealy Vaidya & Nakajima LLP; Tomoko Nakajima

(57) ABSTRACT

Provided is a key sheet in which fixation members such as key tops can be firmly fixed to a base sheet. The back surfaces of the key tops are fixed to a film sheet without involving any gaps by means of adhesion layers 11 stacked on the entire back surfaces of the key tops. Thus, fingernails or the like are not easily allowed to get between the key tops and the film sheet, making it possible to prevent the key tops from being unstuck from the film sheet. Further, in the key sheet, the film sheet and a base sheet are integrated with each other, so the key tops can be firmly fixed to the base sheet through an intermediation of the film sheet, making it possible to prevent the key tops from being detached by fingernails or the like at the time of depressing operation.

10 Claims, 8 Drawing Sheets

KEY SHEET AND PUSHBUTTON SWITCH

BACKGROUND OF THE INVENTION

1. Field of the Invention

The present invention relates to a pushbutton switch key sheet for use in operating portions of various electronic apparatuses, such as a mobile phone, a PDA, a car navigation apparatus, and a car audio apparatus, and more particularly, to a key sheet and pushbutton switch in which a plurality of key tops are exposed through an operational opening having no partition frame formed in a casing of an electronic apparatus.

2. Description of the Related Art

For example, for use in a mobile phone 1, there is known, as shown in FIG. 13, a pushbutton switch in which, for a reduction in size of an operating portion and an improvement in terms of an artistic design of the pushbutton switch, a plurality of key tops 4 of a key sheet 3 are exposed in a dense state through an operational opening 2*a* with no partition frame, which is formed in a casing 2. The number of key tops 4 are seventeen in total, an interval between the adjacent key tops 4 is very small, for example, the interval is set to approximately 0.15 mm to 0.2 mm, and a clearance between the key tops 4 and the operational opening 2*a* is also set to a very small dimension.

For example, in JP 2004-319396 A, as shown in FIG. 14, the conventional key sheet 3 is formed by fixing the key tops 4 to the operating surface side surface of a base sheet 5. The base sheet 5 is equipped with base portions 6 to which the key tops 4 are fixed and which are formed of a silicone rubber and a reinforcing member 7 formed of a resin. Thus, if the key sheet 3 is set upright or tilted during use of the mobile phone 1, it is possible to suppress overall distortion of the key sheet 3 due to the rigidity of the reinforcing member 7. Each base portion 6 is composed of a pedestal portion 6*a* to which the key top 4 is fixed, and a thin-walled flexible portion 6*b* elastically supporting the pedestal portion 6*a*.

In the above key sheet 3, gaps corresponding to the height of the pedestal portions 6*a* are formed in the outer edges on the back side of the key tops 4. Since the casing 2 of the mobile phone 1 has no partition frame, there is a possibility of fingernails or the like entering the gaps during depressing operation on the key tops 4, and there is a fear of the key tops 4 being unstuck or detached from the base sheet 5.

SUMMARY OF THE INVENTION

The present invention has been made in view of the above problem in the prior art. It is accordingly an object of the present invention to provide a key sheet in which fixation members, such as key tops, can be firmly fixed to the base sheet.

In order to achieve the above object, the present invention is constructed as follows. That is, the present invention provides a key sheet which is mounted on a printed circuit board equipped with a contact switch, including: a plurality of key tops; a fixation film which is flat and flexible and to front surfaces of which the back surfaces of the key tops are fixed without involving any gaps; and a base sheet which has a reinforcing member for reinforcing the plane rigidity of the flexible fixation film and whose surface fixed to the back surface of the fixation film is flat.

In the present invention, the back surfaces of the key tops are fixed to the fixation film without involving any gaps. Thus, fingernails or the like are not easily allowed to get between the key tops and the fixation film, making it possible to prevent the key tops from being unstuck from the fixation film by fingernails or the like. In the key sheet of the present invention, this fixation film is integrated with the base sheet, so it is possible to prevent the key tops from being detached by fingernails or the like during depressing operation.

Further, the fixation film is flexible, and can be easily deformed, so it is possible to effect contact switch input through depressing operation on the key tops.

The base sheet to be fixed to the back surface of the fixation film that can be easily deformed has a reinforcing member for reinforcing the plane rigidity of the flexible fixation film. Thus, if the fixation film exhibits flexibility as mentioned above, overall distortion of the key sheet due to the plane rigidity of the reinforcing member can be suppressed. Thus, even if the key sheet is set upright or tilted, generation of overall distortion thereof can be suppressed.

The fixation film to which the key tops are fixed are flat, and the base sheet fixed to the back surface of the fixation film has a flat surface. Thus, a thin key sheet in which the inter-member boundary is flat can be realized.

In the key sheet of the present invention, the back surface of each key top is equipped with an adhesion layer for intimately fixing the entire surface thereof to the fixation film. Since the entire back surface including the external edge of the key top is intimately fixed to the fixation film, it is possible to eliminate a gap inducing separation of the key top between the external edge of the key top and the fixation film. Further, since the entire back surface of the key top is fixed, the depression load applied to the key top at the time of input operation can be easily transmitted through the entire back surface. Thus, a key sheet allowing accurate and reliable input operation can be realized. If the adhesion layer is partially provided within the plane of the back surface of the key top, unevenness in illumination may be generated between the portion where the adhesion layer exists and the portion where no adhesion layer exists when illuminated by a so-called backlight. In the present invention, however, the adhesion layer is provided on the entire back surface, so a key sheet of uniform illumination quality involving no generation of unevenness in illumination can be realized.

In the key sheet of the present invention, the base sheet has a mounting portion for mounting it with its back surface spaced apart from the surface of the printed circuit board, and depression input is performed through the contact switch through curving deformation using the mounting portion as a fulcrum involving no displacement in the depression operating direction through depressing operation of the key top, with the original configuration being restored by canceling the depressing operation. In this way, depression input is performed through the contact switch with the key sheet undergoing curving deformation to exhibit overall warpage at the time of depressing operation, so the need for the pedestal portion 6*a* and the flexible portion 6*b* elastically supporting the pedestal portion 6*a* as used in the prior art can be eliminated. Thus, the thickness of the key sheet can be reduced.

In the key sheet of the present invention, the base sheet has an elastic covering portion formed of a rubber-like elastic material and covering at least one of the front surface and the back surface of the reinforcing member, and depression input is performed through the contact switch through compression deformation of the elastic covering portion through depressing operation of the key top, and the original configuration is restored by canceling the depressing operation. Thus, the deflection of the reinforcing member can be reduced, and the depressing operation load can be reduced. Alternatively, even if the reinforcing member is not deflected, depressing operation on the key top through compression deformation of the elastic covering portion can be performed.

In the key sheet of the present invention, the adhesion layer is the one which is softened or melted through heating. The adhesion layer formed, for example, of a hot-melt adhesive, which is softened or melted through heating, can be freely stacked through thermal transfer in conformity with the area and configuration of the back surface of the key top, making it possible to prevent the adhesive layer from being squeezed out.

In the key sheet of the present invention, the fixation film is formed of a soft resin. At the time of depressing operation on the key top, deformation of the fixation film is involved; however, since the fixation film is soft, the increase in depression load can be minimized. Thus, a light operability, such as that in the case of a structure equipped with no fixation film, can be realized.

In the key sheet of the present invention, the fixation film is formed of a thermoplastic resin, so the fixation film through heating treatment or heating/pressurizing treatment can be softened. Thus, when molding the base sheet, by inserting the fixation film in the mold, the surface of the fixation film brought into contact with the base sheet is softened or melted by the heat and pressure at the time of molding, whereby it is possible to integrate the fixation film simultaneously with the molding of the base sheet.

In the key sheet of the present invention, the reinforcing member has a through-hole extending through the thickness thereof. Thus, the deflection load for the reinforcing member can be minimized, making it possible for the reinforcing member to be deflected easily. At the time of depressing operation of the key top, deformation of the reinforcing member is involved; however, since the reinforcing member is easily deflected, the increase in depression load can be minimized.

In each of the above key sheets of the present invention, it is desirable for the thickness of the key top to range from 0.3 mm to 1.5 mm. When the thickness of the key top is 1.5 mm or less, the key top itself is deflected when depressed, so, at the time of depressing operation, deflection can be effected such that the key sheet as a whole is warped, making it possible to reduce the depression load. On the other hand, in view of the repeatedly performed depressing operation, a thickness of the key sheet of 0.3 mm or more helps to make it relatively free from breakage.

Further, the present invention provides a pushbutton switch having a key sheet and a board within a casing, in which the key sheet includes any one of the above key sheets of the present invention, and in which a fixation film and a base sheet of the key sheet are fixed in a pressurized state between the casing and the board.

In the pushbutton switch of the present invention, the back surfaces of the key tops are fixed to the fixation film without involving any gaps, so fingernails or the like are not easily allowed to get between the key tops and the fixation film, making it possible to prevent the key tops from being unstuck from the fixation film by fingernails or the like. Further, since the fixation film is integrated with the base sheet, it is possible to prevent the key tops from being detached by fingernails or the like during depressing operation. Further, the fixation film is flexible and can be easily deformed, so it is possible to perform input through the contact switch through depressing operation on the key tops. The base sheet fixed to the back surface of the fixation film has a reinforcing member reinforcing the plane rigidity of the flexible fixation film, so even though the fixation film has flexibility as mentioned above, it is possible to suppress overall distortion of the key sheet due to the plane rigidity of the reinforcing member. Thus, even if the key sheet is set upright or tilted, generation of overall distortion thereof can be suppressed. Further, since the fixation film to which the key tops are fixed is flat, and the base sheet to be fixed to the back surface of the fixation film has a flat surface, a thin key sheet in which the inter-member border is flat can be formed, making it possible to realize a thin pushbutton switch.

In the key sheet and the pushbutton switch of the present invention, fingernails or the like are not allowed to easily get between the key tops and the fixation film, making it possible to prevent the key tops from being unstuck from the fixation film by fingernails or the like. The key sheet of the present invention, in which the fixation film and the base sheet are integrated with each other, can firmly fix the key tops to the base sheet through the intermediation of the fixation film, and makes it possible to prevent the key tops from being detached by fingernails or the like at the time of depressing operation.

Since the fixation film is flexible and can be easily deformed, input through the contact switch is possible through depressing operation on the key tops. If the fixation film is flexible, it is possible to suppress overall distortion of the key sheet with the plane rigidity of the reinforcing member.

Since the fixation film to which the key tops are fixed is flat, and the base sheet to be fixed to the back surface of the fixation film has a flat surface, a thin key sheet in which the inter-member boundary is flat can be realized.

The above description of the present invention should not be construed restrictively; the advantages, features, and uses of this invention will become still more apparent from the reading of the following description with reference to the accompanying drawings. Further, it should be understood that all appropriate modifications made without departing from the gist of this invention are to be covered by the scope of this invention.

BRIEF DESCRIPTION OF THE DRAWINGS

In the accompanying drawings.

DETAILED DESCRIPTION OF THE PREFERRED EMBODIMENTS

Figure 1:
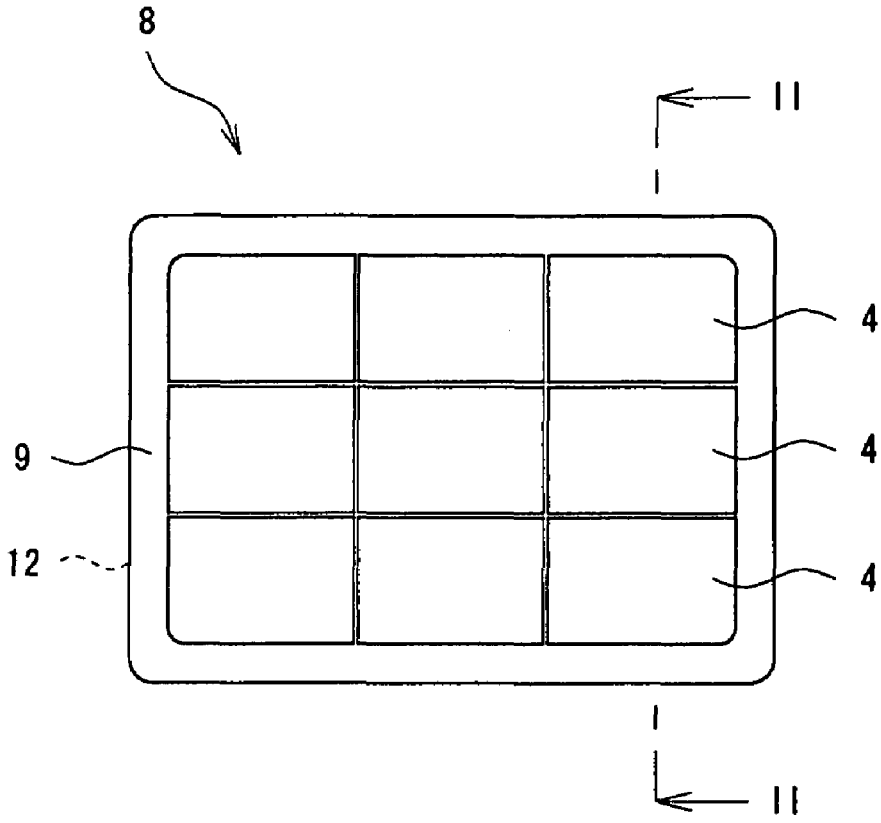
FIG. 1 is a top plan view of a key sheet according to a first embodiment.

Hereinafter, embodiments of the present invention will be described with reference to the drawings. In the drawings, the reference numerals indicate portions and components of the embodiments. The portions and components common to the embodiments are indicated by the same reference numerals, and a redundant description thereof will be omitted.

In the following embodiments, the present invention is applied to a key sheet to be incorporated into the casing (2) of a mobile phone (1) as the "electronic apparatus" as in the prior-art technique. In particular, the present invention will be described as applied to a so-called "small-interval type key sheet", in which a plurality of key tops are exposed through an operational opening with no partition frame formed in the casing (2) of the mobile phone (1).

Figure 2:
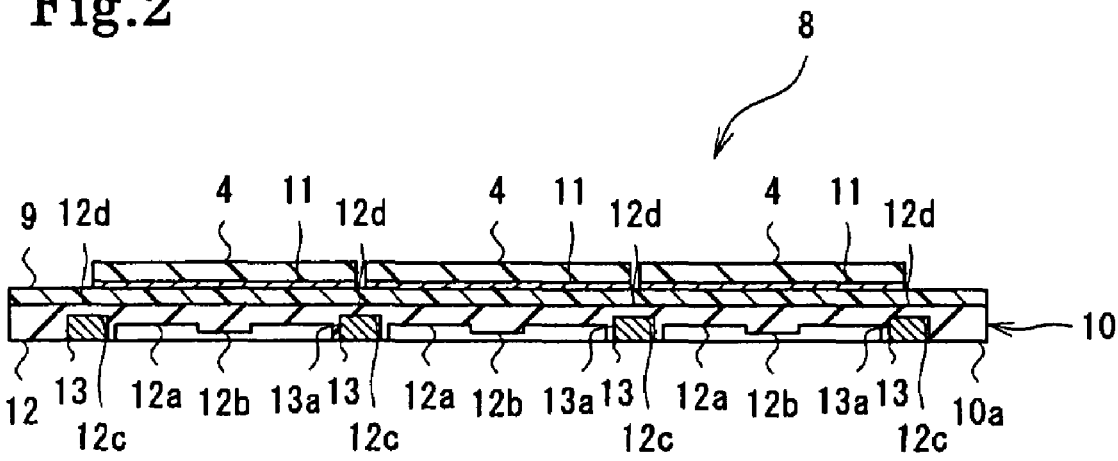
FIG. 2 is a sectional view taken along the line II-II of FIG. 1.
Figure 3:
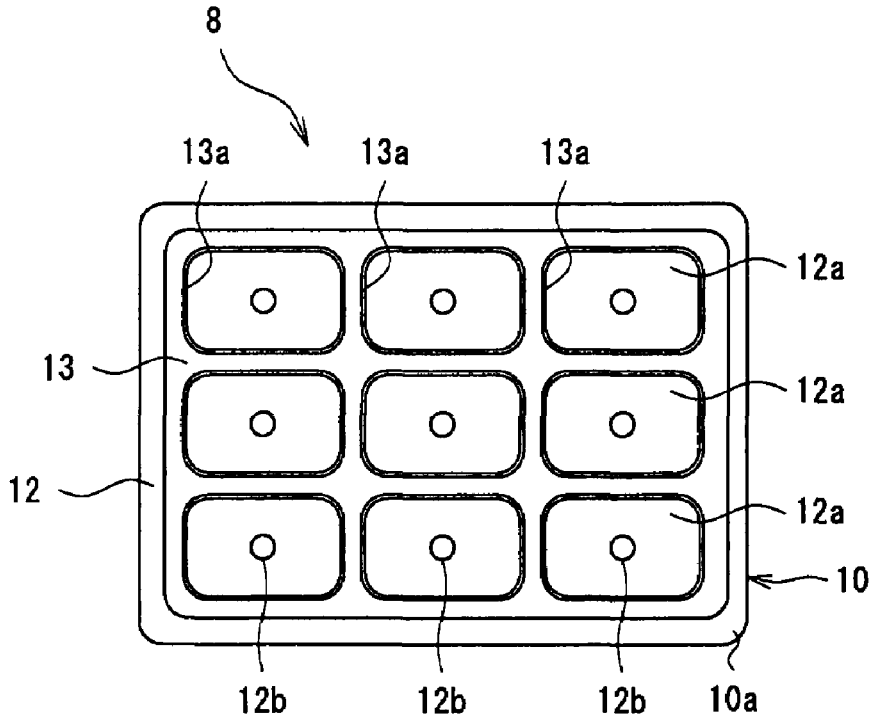
FIG. 3 is a bottom view of the key sheet of the first embodiment.

First Embodiment (FIGS. 1 through 4): FIGS. 1 through 3 show a key sheet 8 according to a first embodiment. The key sheet 8 of the first embodiment is equipped with key tops 4, a film sheet 9 as the "fixation film", and a base sheet 10.

The key tops 4 are formed of a polycarbonate type hard resin. They are of a rectangular configuration in plan view; in this embodiment, their thickness is 0.4 mm. On the front surface constituting the operating surface for the key tops 4, there are provided decorations including numbers, characters, etc. formed on print layers, coating layers or the like; on the entire back surface on the opposite side of the front surface, there is stacked an adhesion layer 11 formed of a thermal softening type hot-melt adhesive. It is also possible for the decorations in the form of print layers, coating layers or the like to be provided on either in between the adhesion layer 11 and the back surface of the key tops 4 or at least the front surface or the back surface of the film sheet 9.

The film sheet 9 is a flat sheet formed of a polyurethane type soft thermoplastic resin; in this embodiment, it has a thickness of 50 μm. Nine key tops 4 are fixed to the front surface thereof through the intermediation of adhesion layers 11 without involving any gaps; the back surface thereof is fixed to the surface of the flat base sheet 10.

The base sheet 10 is composed of a rubber sheet 12 formed of a rubber-like elastic material formed of a silicone rubber, and a reinforcing plate 13 as the "reinforcing member" formed of a polycarbonate type hard resin. Of those, the rubber sheet 12 has a flat surface. On the back surface thereof, there are formed recesses 12*a* at positions in alignment with the key tops 4. At the centers of the bottom surfaces of the recesses 12*a*, there protrude pusher portions 12*b* for depressing contact switches 14 composed of opposing belleville springs. Further, there is formed a groove portion 12*c* so as to surround the periphery of each recess 12*a*. In this embodiment, the reinforcing plate 13 has a thickness of 500 μm, and is formed as a holed frame having through-holes 13*a* extending through the thickness thereof at the positions corresponding to the key tops 4. Then, the frame portion thereof is fixed to the interior of the groove portion 12*c* of the rubber sheet 12. That is, the rubber sheet 12 has an elastic covering portion 12*d* covering the surface of the reinforcing plate 13.

Figure 4:
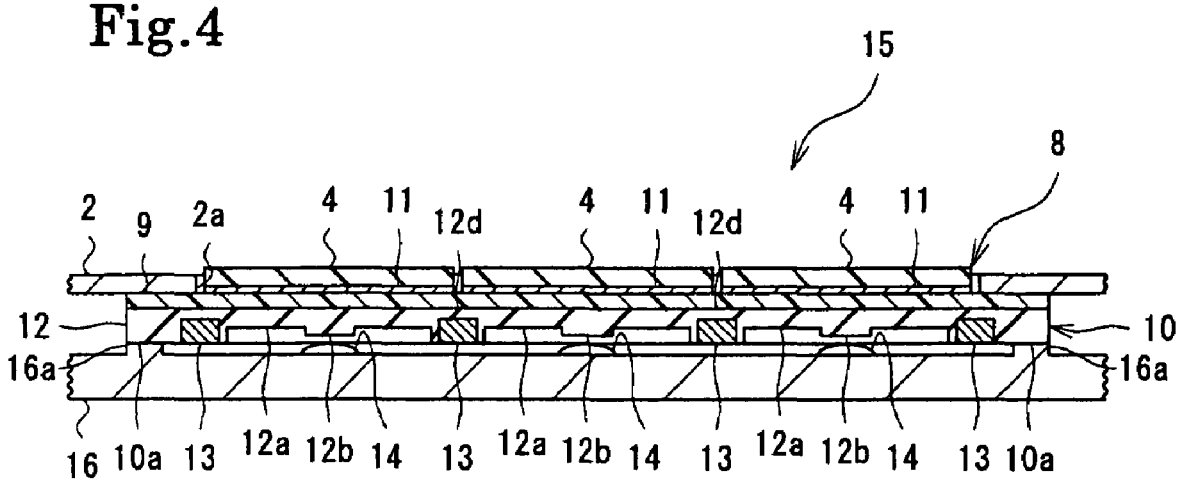
FIG. 4 is an enlarged main portion sectional view of an apparatus equipped with the key sheet of the first embodiment.

Next, a pushbutton switch 15 equipped with the key sheet 8 of the first embodiment will be described with reference to FIG. 4. Apart from the above key sheet 8, the pushbutton switch 15 is equipped with a board 16 incorporated into a casing 2. In the pushbutton switch 15, the key tops 4 are exposed through an operational opening 2*a* of the casing 2, and an external edge 10*a* as the "mounting portion" of the base sheet 10 is held in a pressurized state between the casing 2 and a protrusion 16*a* of the board 16 such that the pusher portions 12*b* are matched with the contact switches 14. In this way, the base sheet 10 is mounted with its back surface spaced apart from the surface of the board 16. When the key tops 4 of the pushbutton switch 15 are depressed, the key sheet 8 as a whole is curved and deformed so as to be warped and deflected using the external edge 10*a* as a fulcrum not to be displaced in the depressing direction, and the pusher portions 12*b* depress the contact switches 14 to thereby effect input.

Here, the materials of the components of the key sheet 8 will be described. The following description will also be applicable to the other embodiments described below.

It is desirable for the material of the "hard resin" used in forming the key tops 4 to be the thermoplastic resin or a reactive curing resin from the viewpoint of the requisite performance such as mechanical strength and durability, and a reduction in weight. Examples of the resin to be used in this embodiment include apart from a polycarbonate resin, a polymethyl methacrylate resin, a polypropylene resin, a polystyrene resin, a polyacryl copolymer resin, a polyolefin resin, an acrylonitrile butadiene styrene resin, a polyester resin, an epoxy resin, a polyurethane resin, a polyamide resin, and a silicone resin. Of those hard resins, taking workability into consideration, the polycarbonate resin, the polymethyl methacrylate resin, the polyacryl copolymer resin, and the acrylonitrile butadiene styrene resin are preferable, and taking transparency into consideration, the polycarbonate resin, the polymethyl methacrylate resin, and the polyacryl copolymer resin are preferable.

It is desirable for the material forming the adhesion layers 11 to be an adhesive, such as a resin, a wax, or a rubber, which have mechanical strength and durability. For example, it is possible to use a polyacrylic type, vinyl chloride type, polyester type, or polyurethane type material. As the form of adhesive, it is desirable to use a hot-melt adhesive or the like, which is a solvent dilution type and a heat adhesion type adhesive, which allows highly precise printing, and which is brought into a solid state through evaporation of the solvent after being applied to the object concerned and is free from dripping and facilitates the maintaining of the initial print form; in particular, a thermal softening type adhesive, which is relatively free from deformation of the adhesion layers 11 in the adhesion process, is more desirable than a thermal melting type adhesive.

It is desirable for the material forming the film sheet 9 to be a resin which is thin but of high tensile strength. Apart from the polyurethane resin used in this embodiment, it is possible to use, for example, the following materials in the form of a unitary material or a composite material: a polyethylene resin, a polypropylene resin, a polyamide resin, a polyvinyl chloride resin, a polycarbonate resin, an acrylonitrile butadiene styrene resin, a polyethylene terephthalate resin, a polybutylene terephthalate resin, a polyphenylene oxide resin, a polyphenylene sulfide resin, a polyurethane resin, a polyphenylene ether resin, a denatured polyphenylene ether resin, a polyketone resin, and liquid crystal polymer. Among those, the polyamide resin, the polyurethane resin, the polyvinyl chloride resin, etc., which are relatively thin, flexible, and free from rupture, are preferable. A "thermoplastic resin" will be softened or melted by heating to allow firm fixation to another member.

It is desirable for the material of the "rubber-like elastic member" used in forming the rubber sheet 12 to be a rubber of high rebound resilience or a thermoplastic elastomer. Examples of the rubber apart from that can be used in this embodiments include, a natural rubber, an ethylene propylene rubber, a butadiene rubber, an isoprene rubber, a chloroprene rubber, and a urethane rubber, and examples of the thermoplastic elastomer that can be used include a styrene type thermoplastic elastomer, an olefin type thermoplastic elastomer, an ester type thermoplastic elastomer, a urethane type thermoplastic elastomer, an amide type thermoplastic elastomer, a butadiene type thermoplastic elastomer, an ethylene-vinyl-acetate type thermoplastic elastomer, a fluoro-rubber type thermoplastic elastomer, an isoprene type thermoplastic elastomer, and a chlorinated polyethylene type thermoplastic elastomer. Of those rubber-like elastic materials, taking durability into consideration, the styrene type thermoplastic elastomer and the ester type thermoplastic elastomer are preferable. Further, taking its low temperature dependence into consideration, a silicone rubber is preferable. In the case of a silicone rubber, use of an addition-setting type one, in which an organosilicon compound having aromatic rings and nitrogen atoms are mixed, facilitates the adhesion to the film sheet better.

As the material forming the reinforcing plate 13, it is desirable to use a thermoplastic or reaction-setting resin or a metal from the viewpoint of the requisite performance, such as mechanical strength and durability, and the requirement for a reduction in weight. Apart from the polycarbonate resin used in this embodiment, examples of the resin that can be used included a polymethacrylate resin, a polypropylene resin, a polystyrene resin, a polyacrylic copolymer resin, a polyolefin resin, an acrylonitrile butadiene styrene resin, a polyester resin, an epoxy resin, a polyurethane resin, a polyamide resin, and a silicone resin. Taking workability of those hard resins into consideration, the polycarbonate resin, the polymethylmethacrylate resin, the polyacrylic copolymer resin, and the acrylonitrile butadiene styrene resin are preferable; and taking transparency into consideration, the polycarbonate resin, the polymethylmethacrylate resin, and the polyacrylic copolymer resin are preferable. Examples of the metal that can be used include stainless steel, aluminum, chromium, iron, gold, silver, copper, nickel, and tin, which can be used singly or in the form of an alloy. Above all, stainless steel, aluminum, gold, copper, etc., which easily allow sheet metal working, are preferable. The thickness of the reinforcing plate 13 preferably ranges from 100 μm to 2000 μm in the case of a resin, and from 20 μm to 2000 μm in the case of a metal. When the thickness is smaller than the above range, the requisite rigidity cannot be attained, resulting in generation of distortion in the key sheet 8. On the other hand, when the thickness is larger than 2000 μm, the key sheet 8 as a whole becomes rather thick.

Next, an example of a method of manufacturing the key sheet 8 of the first embodiment will be described. First, the reinforcing plate 13 of a polycarbonate resin is molded by injection molding. At this time, the through-holes 13*a* extending through the thickness are formed by the cavity of the injection molding mold. Next, the film sheet 9 of a polyurethane type soft thermoplastic resin and the previously formed reinforcing plate 13 are inserted in the mold for molding the base sheet 10, and then a silicone rubber is charged into the mold, whereby the film sheet 9, the rubber sheet 12, and the reinforcing plate 13 are integrated with each other to mold the base sheet 10 having the film sheet 9 on the surface. On the other hand, the key tops 4 of a polycarbonate resin are molded by injection molding, and after decorating their surfaces heat-transferring the adhesion layers 11 formed of a heat-melting type hot-melt adhesive to the entire back surfaces thereof. Finally, the adhesion layers 11 are opposed to the surface of the film sheet 9, and the key tops 4 are heat-transferred, thereby obtaining the key sheet 8.

Finally, the effects of the key sheet 8 of this embodiment will be described.

In the key sheet 8 of the first embodiment, the back surfaces of the key tops 4 are fixed to the film sheet 9 without involving any gaps due to the adhesion layers 11 stacked on the entire back surfaces of the key tops 4. Thus, fingernails or the like do not easily get into an opening between the key tops 4 and the film sheet 9, making it possible to prevent the key tops 4 from being unstuck from the film sheet 9 by fingernails or the like.

Further, at the time of input operation, the depression load applied to the key tops 4 is transmitted through the entire back surfaces thereof. Thus, it is possible to realize a key sheet allowing accurate and reliably input operation. Further, since the adhesion layers 11 are provided on the entire back surfaces, no unevenness in illumination is generated when backlight illumination is effected, making it possible to realize a key sheet of a uniform illumination quality.

The film sheet 9 is flexible and can be easily deformed, so it allows input through the contact switches 14 through depressing operation on the key tops 4. Although the film sheet 9 is flexible, it is possible to suppress overall distortion of the key sheet 8 due to the plane rigidity of the reinforcing plate 13. Thus, even if the key sheet 8 is set upright or tilted, it is possible to suppress generation of overall distortion.

Since the film sheet 9 is flat, and the front surface of the base sheet 10 bonded to the back surface of the film sheet 9 is flat, it is possible to realize a thin key sheet 8 in which the inter-member boundary is flat.

At the time of depressing operation on the key tops 4, the key sheet 8 undergoes curving deformation and is deflected so as to be generally warped using the external edge 10*a* as the fulcrum not displaced in the depressing direction, and the pusher portions 12*b* depress the contact switches 14 to thereby effect input. Thus, there is no need to provide the pedestal portions 6*a* and the flexible portions 6*b* elastically supporting the pedestal portions 6*a* as in the prior art. Thus, it is possible to achieve a reduction in the thickness of the key sheet 8. While in this embodiment the external edge 10*a* of the base sheet 10 serves as the mounting portion, it is also possible to use the intervals between the key tops 4 as the mounting portions.

Since the adhesion layers 11 are formed of a hot-melt adhesive that is softened through heating, stacking becomes possible through thermal transfer in an area equal to the entire back surface of the key tops 4. Thus, it is possible to prevent the adhesion layers 11 from being squeezed out, thus preventing an increase in operation load due to the adhesion layers squeezed out at the time of depressing operation.

Since the film sheet 9 is formed of a polyurethane type soft resin, it is possible to minimize an increase in depression load due to deformation of the film sheet 9 at the time of depressing operation on the key tops 4. Thus, it is possible to realize the same light operability as that of a structure equipped with no film sheet 9.

Further, since the film sheet 9 is formed of a polyurethane type thermoplastic resin, the film sheet 9 can be softened through heating and pressurization. Thus, by inserting the film sheet 9 in the mold when molding the base sheet 10, the surface of the film sheet 9 held in contact with the base sheet 10 is softened due to the heat and pressure at the time of molding, making it possible to integrate the film sheet 9 simultaneously with the molding of the base sheet 10.

Since the reinforcing plate 13 has the through-holes 13*a* extending through the thickness thereof, it is possible to minimize the deflection load of the reinforcing plate 13, making it easier for the reinforcing plate 13 to be deflected. Thus, it is possible to minimize the increase in depressing operation load at the time of depressing operation on the key tops 4.

While in the first embodiment described above indicating an example of the base sheet 10 being spaced apart from the surface of the board 16 by the protrusions 16*a* formed on the board 16, it is also possible to provide, in a first modification, a protrusion directed toward the board 16 at the external edge 10*a* of the back surface of the base sheet 10, thereby separating the base sheet 10 from the surface of the board 16.

Further, while in the first embodiment described above indicated an example of the pusher portions 12*b* being above the contact switches 14, it is also possible, in a second modification, to form them in a length large enough to be placed on the contact switches 14.

Figure 5:
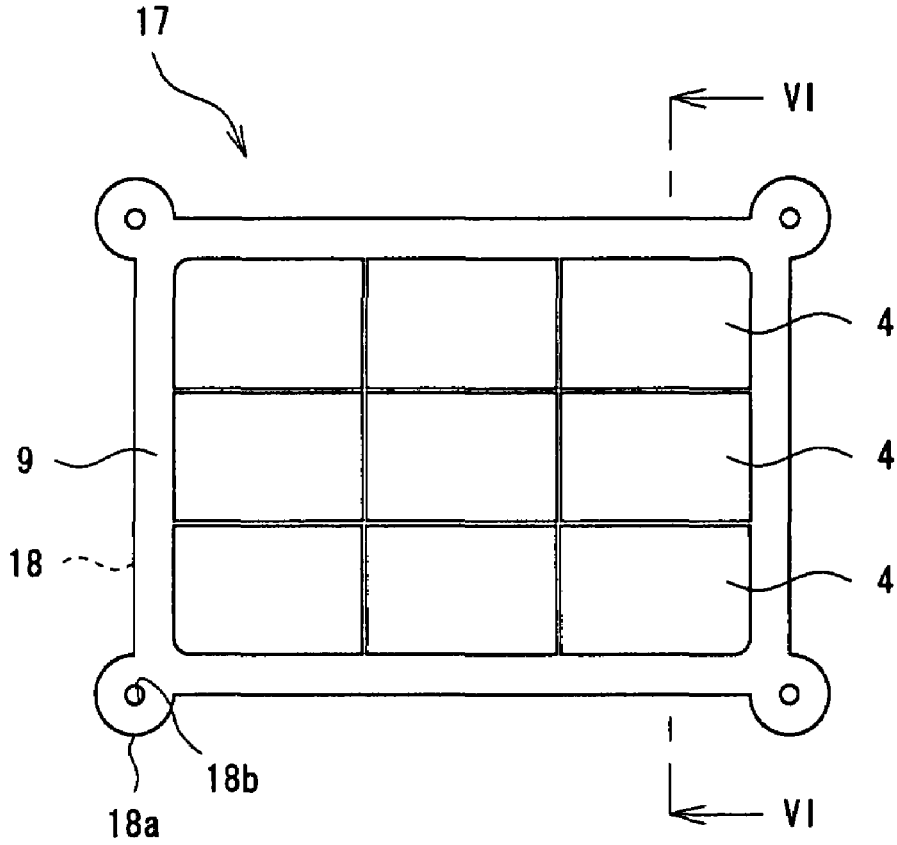
FIG. 5 is a top plan view of a key sheet according to a second embodiment.
Figure 6:
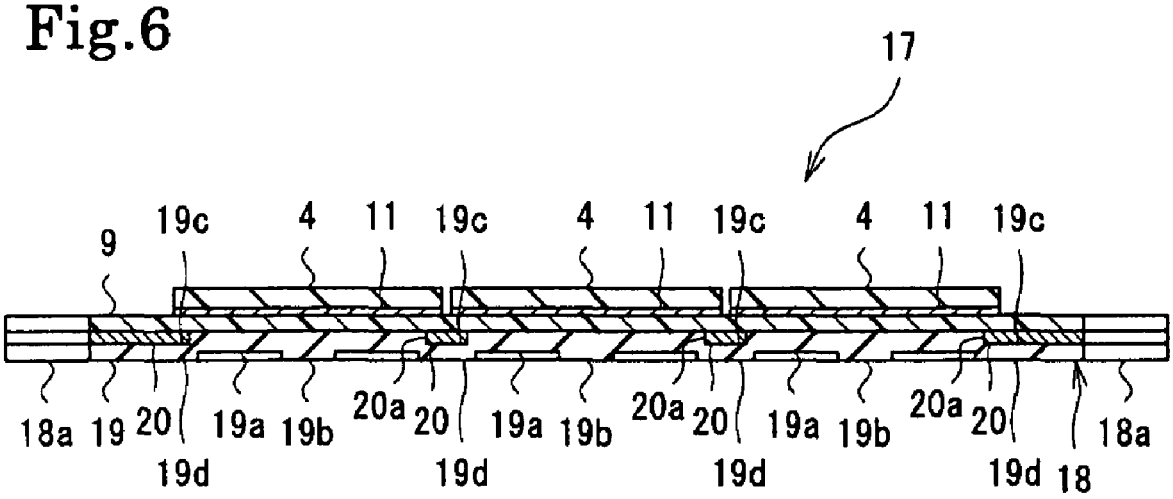
FIG. 6 is a sectional view taken along the line VI-VI of FIG. 5.

Second Embodiment (FIGS. 5 through 7): FIGS. 5 and 6 show a key sheet 17 according to a second embodiment. The key sheet 17 of the second embodiment differs from the key sheet 8 of the first embodiment in the construction of the base sheet 18 thereof. Otherwise, it is of the same construction and effect as that of the first embodiment.

The base sheet 18 is composed of a rubber sheet 19 formed of a rubber-like elastic material formed of a silicone rubber, and a reinforcing plate 20 formed of stainless steel and serving as the "reinforcing member". As in the case of the rubber sheet 12 of the first embodiment, recesses 19*a* are formed in the back surface of the rubber sheet 19 at the positions matched with the key tops 4. At the centers of the bottom surfaces of the recesses 19*a*, there protrude pusher portions 19*b* for depressing the opposing contact switches 14. However, the portion around each recess 19*a* is flat, and a groove portion 19*c* is formed in the front surface of the rubber sheet 19, retaining the reinforcing plate 20. In this embodiment, the reinforcing plate 20 has a thickness of 100 μm, and is formed as a holed frame having through-holes 20*a* extending through the thickness thereof at positions corresponding to the key tops 4. That is, the rubber sheet 19 has an elastic covering portion 19*d* covering the back surface of the reinforcing plate 20. At the four corners of the base sheet 18, there are provided, together with the film sheet 9, substantially circular mounting members 18*a* serving as the "mounting portions", and mounting holes 18*b* are formed at the centers of the mounting members 18*a*.

Figure 7:
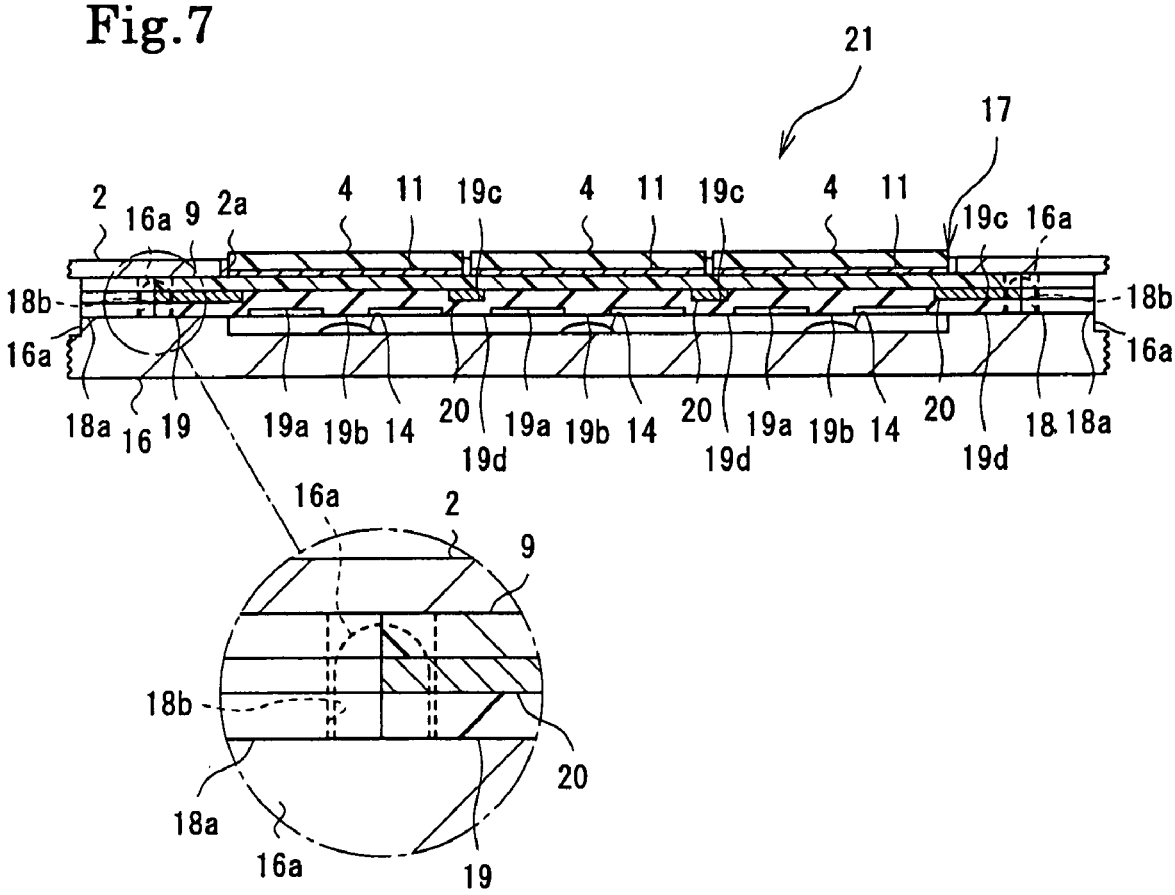
FIG. 7 is an enlarged main portion sectional view of an apparatus equipped with the key sheet of the second embodiment.

Next, a pushbutton switch 21 equipped with the key sheet 17 of the second embodiment will be described with reference to FIG. 7. As in the case of the first embodiment, the pushbutton switch 21 is equipped, apart from the key sheet 17 described above, with the board 16 incorporated into the casing 2. In the pushbutton switch 21, the key tops 4 are exposed through the operational opening 2*a*, and the mounting members 18*a* of the base sheet 18 are held in a pressurized state between the casing 2 and the protrusion 16*a* of the board 16 such that the pusher portions 19*b* are matched with the contact switches 14. Further, in this embodiment, mounting pins 16*b* protruding from the protrusions 16*a* of the board 16 are inserted into the mounting holes 18*b* of the base sheet 18, thereby preventing positional deviation of the base sheet 18. In this way, mounting is effected with the back surface of the base sheet 18 spaced apart from the front surface of the board 16. When the key tops 4 of the pushbutton switch 21 are depressed, the key sheet 17 as a whole undergoes curving deformation and is deflected so as to be warped using the mounting members 18*a* as the fulcrum not displaced in the depressing direction, and the pusher portions 19*b* depress the contact switches to thereby effect input.

Here, an example of a method of manufacturing the key sheet 17 of the second embodiment will be described. First, the reinforcing plate 20 formed of stainless steel is formed by stamping. At this time, through-holes 20*a* extending through the thickness are also formed by stamping. Next, the film sheet 9 formed of a polyurethane type soft thermoplastic resin, and the previously formed reinforcing plate 20 are inserted in the mold for molding the base sheet 18 before charging a silicone rubber into mold to integrate the film sheet 9, the rubber sheet 19, and the reinforcing plate 20, whereby there is molded the base sheet 17 having the film sheet 9 on its front surface. On the other hand, the key tops 4 formed of polycarbonate resin are molded by injection molding, and after decorating their front surfaces forming on the entire back surfaces thereof the adhesion layers 11 formed of a heat-softening type hot-melt adhesive by screen printing. Finally, the adhesion layers 11 are opposed to the front surface of the film sheet 9, and the key tops 4 are heat-transferred to thereby obtain the key sheet 17.

The key sheet 17 of the second embodiment provides the same effects as the key sheet 8 of the first embodiment. Further, it also provides the following effect.

In the key sheet 17, the elastic covering portion 19*d* covers the back surface of the reinforcing plate 20 formed of stainless steel, so it is possible to prevent the reinforcing plate 20 from coming into contact with the board 16 when the key tops 4 are depressed. The reinforcing plate 20, which is formed of stainless steel, has conductivity, so it is necessary to prevent it from coming into contact with a circuit, etc. on the board 16. In this embodiment, it is possible to prevent the reinforcing plate 20 from coming into contact with the board 16, making it possible to avoid malfunction and failure due to short-circuiting or false signals caused by contact of the board with the reinforcing plate 20.

Figure 8:
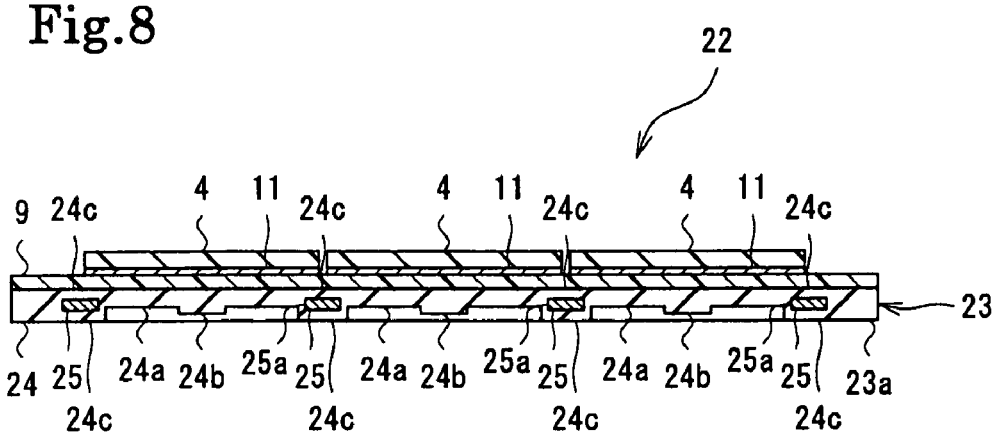
FIG. 8 is a sectional view, corresponding to FIG. 2, of a key sheet according to a third embodiment.

Third Embodiment (FIGS. 8 and 9): FIG. 8 shows a key sheet 22 according to a third embodiment. The key sheet 22 of the third embodiment differs from the key sheet 8 of the first embodiment in the construction of the base sheet 23. Otherwise, it is of the same construction and effect as the first embodiment.

The base sheet 23 is composed of a rubber sheet 24 formed of a rubber-like elastic material formed of a silicone rubber and a reinforcing plate 25 formed of stainless steel and serving as the "reinforcing member". As in the case of the rubber sheet 12 of the first embodiment, recesses 24*a* are formed in the back surface of the rubber sheet 24 at positions matched with the key tops 4. At the centers of the recesses 24*a*, there protrude pusher portions 24*b* for depressing the opposing contact switches 14 by a length smaller than the depth of the recesses 24*a*. The portion around each recess 24*a*, however, is flat, with the reinforcing plate 25 being embedded within the rubber sheet 24. In this embodiment, the reinforcing plate 25 has a thickness of 100 μm, and is formed as a holed frame having through-holes 25*a* extending through the thickness thereof. The rubber sheet 24 has an elastic covering portion 24*c* covering the front surface and the back surface of the reinforcing plate 25.

Figure 9:
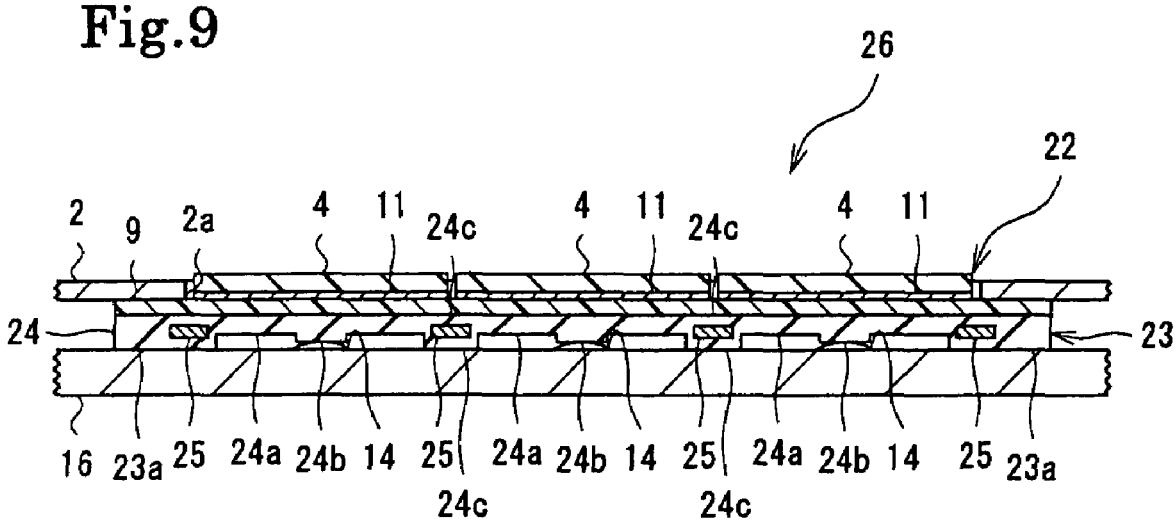
FIG. 9 is an enlarged main portion sectional view of an apparatus equipped with the key sheet of the third embodiment.

Next, a pushbutton switch 26 equipped with the key sheet 23 of the third embodiment will be described with reference to FIG. 9. As in the first embodiment, apart from the key sheet 23 described above, the pushbutton switch 26 is equipped with the board 16 incorporated into the casing 2. In the pushbutton switch 26, the key tops 4 are exposed through the operational opening 2*a*, and an external edge 23*a* as the "mounting portion" of the base sheet 23 is held in a pressurized state between the casing 2 and the board 16 such that the pusher portions 24*b* are matched with the contact switches 14.

The back surface of the rubber sheet 24 is in contact with the board 16 except for the recesses 24*a*. When the key tops 4 of the pushbutton switch 26 are depressed, the pusher portions 24*b* depress the contact switches 14 to effect input while compressing and crushing the elastic covering portion 24*c* of the rubber-like elastic material through the soft film sheet 9.

Here, an example of the method of manufacturing the key sheet 22 of the third embodiment will be described. The method is similar to that of the key sheet 17 of the second embodiment. First, the reinforcing plate 25 of stainless steel is formed by stamping. Next, the film sheet 9 and the previously formed reinforcing plate 25 are inserted in the mold for molding the base sheet 23, and then a silicone rubber is charged into the mold to integrate the film sheet 9, the rubber sheet 24, and the reinforcing plate 25, molding the base sheet 23 having the film sheet 9 on the front surface. On the other hand, the key tops 4 are molded, and, after decorating their front surfaces, the adhesion layers 11 formed of a heat-softening type hot-melt adhesive are formed on the entire back surfaces thereof through pad printing. Finally, the adhesion layers 11 are opposed to the surface of the film sheet 9, and the key tops 4 are heat-transferred to thereby obtain the key sheet 22.

The key sheet 22 of the third embodiment provides the same effects as the key sheet 8 of the first embodiment. Further, it provides the following effects.

In the key sheet 22, the elastic covering portion 24*c* of a silicone rubber covers the front surface and back surface of the reinforcing plate 25. Therefore, when the key tops 4 are depressed, it can be softly crushed on the front side and back side of the reinforcing plate 25, making it possible to push down the key tops 4 even if the back surface of the rubber sheet 24 is in contact with the board 16. Thus, even if the reinforcing plate 25 undergoes little deflection, it is possible to perform depressing operation on the key tops. The reinforcing plate 25, which is formed of stainless steel, has conductivity. However, since the elastic covering portion 24*c* covers the back surface of the reinforcing plate 25, it is possible to prevent it from coming into contact with the board 16, enabling to avoid malfunction and failure due to short-circuiting and false signals caused by contact with the reinforcing plate 25.

Figure 10:
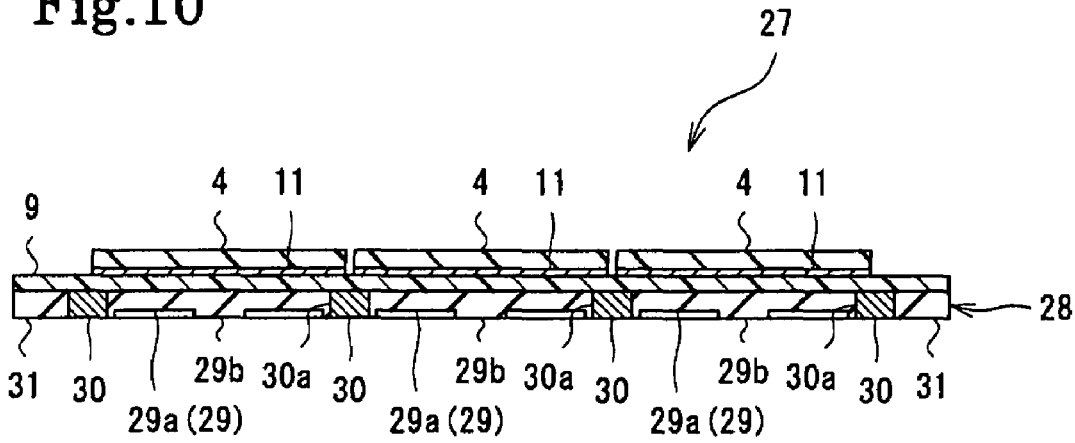
FIG. 10 is a sectional view, corresponding to FIG. 2, of a key sheet according to a fourth embodiment.

Fourth Embodiment (FIGS. 10 and 11): FIG. 10 shows a key sheet 27 according to a fourth embodiment. The key sheet 27 of the fourth embodiment differs from the key sheet 8 of the first embodiment in the construction of the base sheet 28. Otherwise, it is of the same construction and effects as that of the first embodiment.

The base sheet 28 is composed of stopping portions 29 made of a rubber-like elastic material formed of a silicone rubber, a reinforcing plate 30 made of a polycarbonate type hard resin, and an external edge portion 31 made of a rubber-like elastic material formed of a silicone rubber. Of those, the stopping portions 29 are situated so as to be matched with the key tops 4, that is, fixed to the hole walls of the through-holes 30*a* so as to stop the through-holes 30*a* of the reinforcing plate 30, and recesses 29*a* are formed in the back surface thereof. At the centers of the bottom surfaces of the recesses 29*a*, there protrude pusher portions 29*b* for depressing the opposing contact switches 14. In this embodiment, the reinforcing plate 30 has a thickness of 500 μm, and is formed as a holed frame in which, as described above, the through-holes 30*a* extending through the thickness thereof are formed at positions corresponding to the key tops 4. An external edge portion 31 is fixed to the outer peripheral side surface of the reinforcing plate 30.

Figure 11:
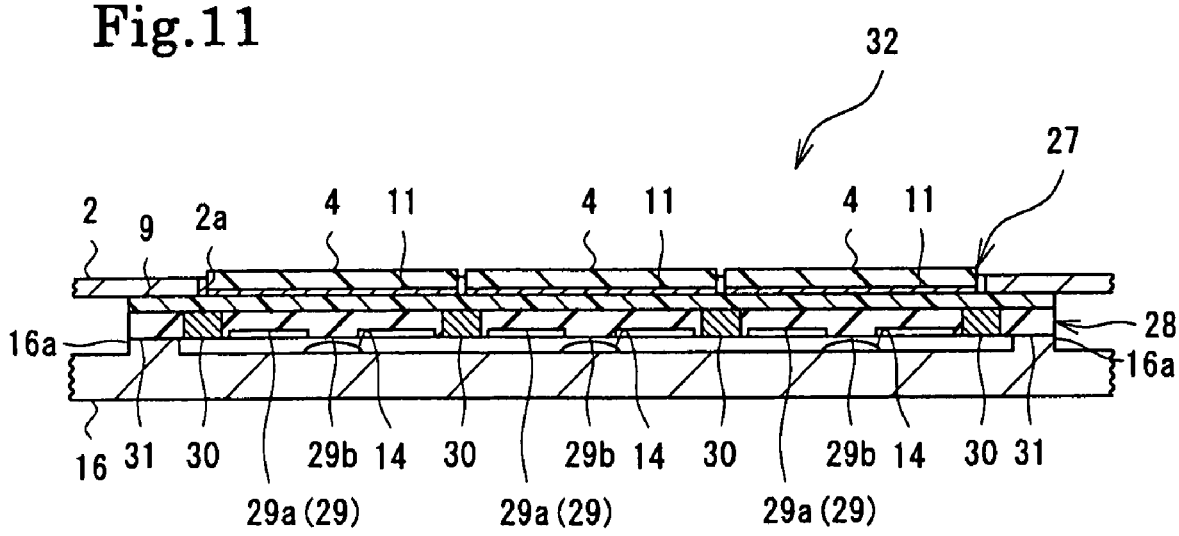
FIG. 11 is an enlarged main portion sectional view of an apparatus equipped with the key sheet of the fourth embodiment.

Next, a pushbutton switch 32 equipped with the key sheet 27 of the fourth embodiment will be described with reference to FIG. 11. Apart from the key sheet 27 described above, the pushbutton switch 32 is equipped with the board 16 incorporated into the casing 2. In the pushbutton switch 32, the key tops 4 are exposed through the operational opening 2*a*, and the external edge portion 31 serving as the "mounting portion" for the base sheet 28 is held in a pressurized state between the casing 2 and the board 16 such that the pusher portions 29*b* are matched with the contact switches 14. In this way, mounting is effected with the back surface of the base sheet 28 spaced apart from the surface of the board 16. When the key tops 4 of the pushbutton switch 32 are depressed, the key sheet 27 undergoes curving deformation and is deflected so as to be generally warped using the external edge portion 31 as the fulcrum free from being displaced in the depressing direction thereof, and the pusher portions 29*b* depress the contact switches 14 to effect input.

Here, an example of the method of manufacturing the key sheet 27 of the fourth embodiment will be described. The method is similar to that for the key sheet 8 of the first embodiment. First, the reinforcing plate 30 formed of a polycarbonate resin is molded. Next, the film sheet 9 formed of a polyurethane type soft thermoplastic resin, and the reinforcing plate 30 previously formed are input in the mold for molding the base sheet 28, and then a silicone rubber is charged into the mold to integrate the film sheet 9, the stopping portions 29, the reinforcing plate 30, and the external edge portion 31 with each other to thereby mold the base sheet 28 having the film sheet 9 on the surface. On the other hand, the key tops 4 made of a polycarbonate resin are formed. After decorating the front surfaces thereof, the adhesion layers 11 formed of a heat-softening type hot-melt adhesive are heat-transferred to the entire back surfaces thereof. Finally, the adhesion layers 11 are opposed to the surface of the film sheet 9, and the key tops 4 are heat-transferred, whereby the key sheet 27 is obtained.

The key sheet 27 of the fourth embodiment provides the same effects as the key sheet 8 of the first embodiment. Further, it provides the following effect.

In the key sheet 27, the stopping portions 29 are formed so as to fill the interior of the through-holes 30*a* of the reinforcing plate 30, so the thickness of the base sheet 28 is the thickness of the reinforcing plate 30. Thus, unlike the key sheets of the other embodiments, the key sheet of this embodiment allows elimination of the thickness of the rubber sheet, making it possible to reduce the thickness of the key sheet 27 as a whole.

Figure 12:
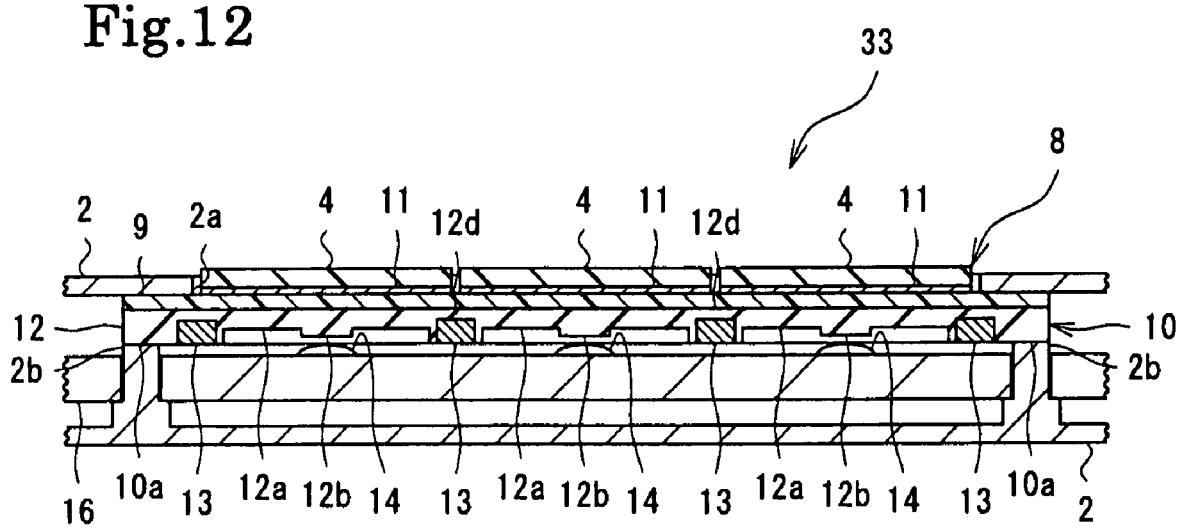
FIG. 12 is an enlarged main portion sectional view of another apparatus equipped with the key sheet of the first embodiment.
Figure 13:
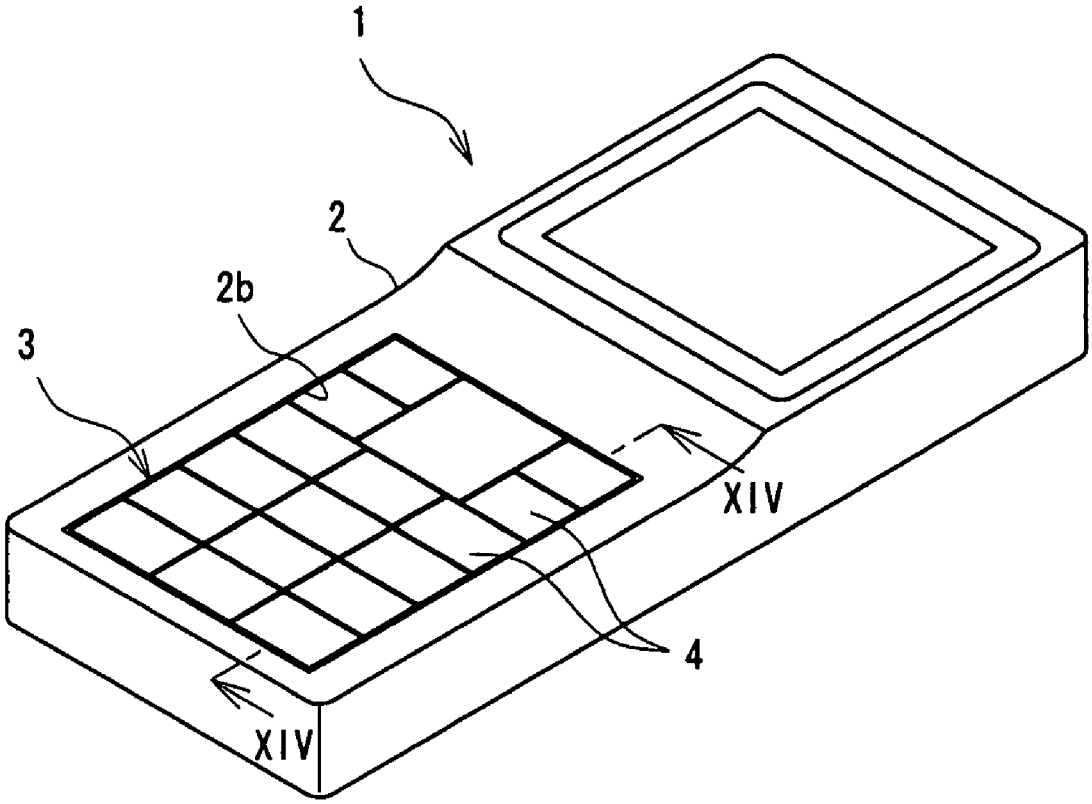
Fig.13 Related Art
FIG. 13 is an outward appearance view of a mobile phone equipped with a key sheet.
Figure 14:
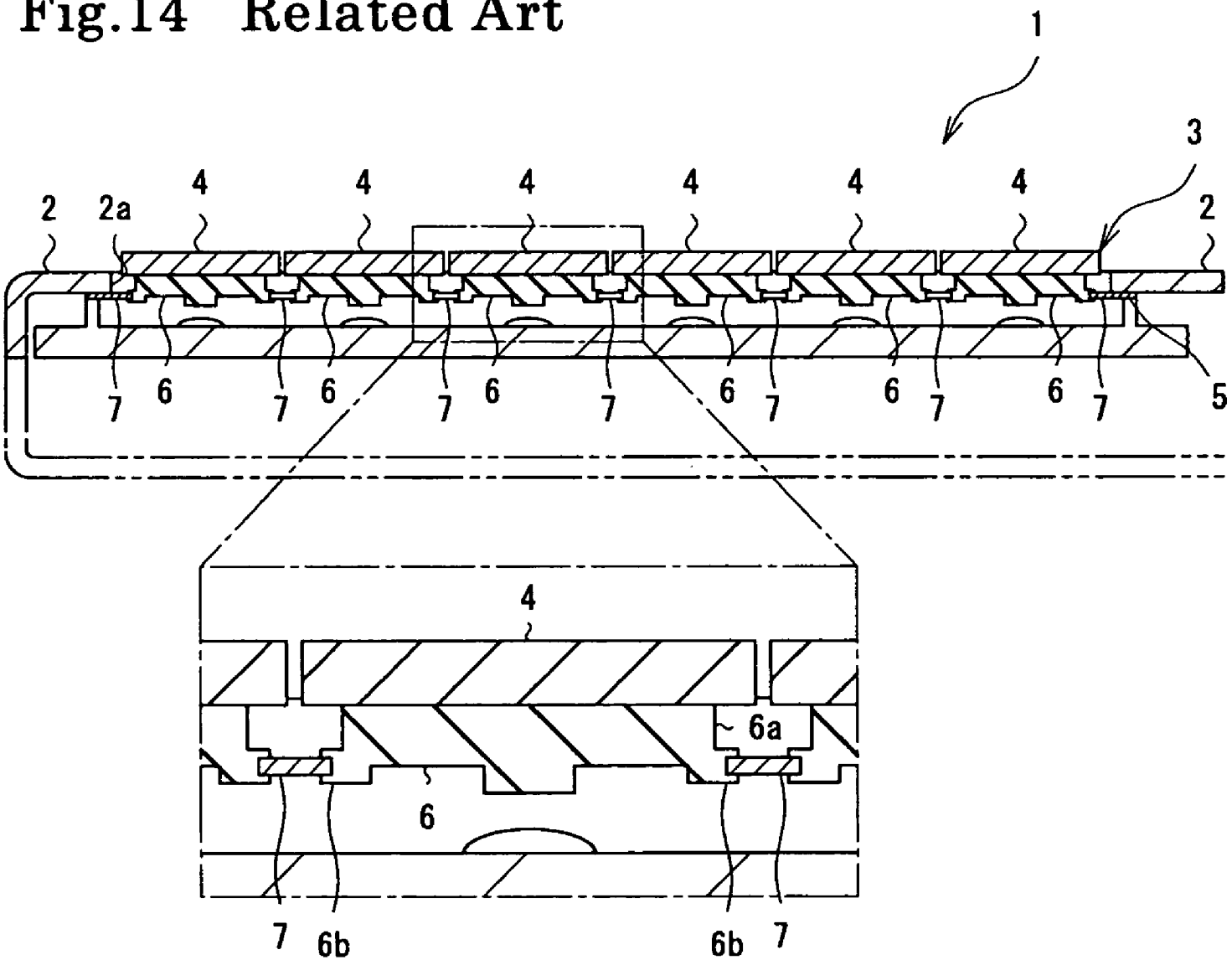
Fig.14 Related Art
FIG. 14 is a sectional view taken along the line XIV-XIV of FIG. 13.

Modifications of the Above Embodiments: Apart from the above modifications, the above embodiments allow the following modifications: For example, in the pushbutton switch 15, 21, 32 equipped with the key sheet 8, 17, 27 of the first, second, fourth embodiment, respectively, the key sheet 8, 17, 27 is supported by the protrusion 16*a* formed on the board 16 (FIGS. 4, 7, and 11, respectively). However, as in the case of the third embodiment, it is also possible to provide the protrusion on the back surface of the base sheet 10, 18, 28. Further, as in the case of the pushbutton switch 33 shown in FIG. 12, it is also possible to provide through-holes 16*c* in the board 16, and to provide protrusions 2*b* in the casing 2, holding the key sheet 8 by the forward ends of the protrusions 2*b* passed through the through-holes 16*c*. While in FIG. 12 the key sheet 8 of the first embodiment is shown as a typical example, it is also possible to apply this modification to the other key sheets 17, 27.

What is claimed is:

1. A key sheet which is mounted on a printed circuit board equipped with a contact switch, comprising:

a plurality of key tops;

a fixation film which is flat and flexible and to front surfaces of which back surfaces of the key tops are fixed without involving any gaps; and a base sheet which has a reinforcing member for reinforcing the plane rigidity of the flexible fixation film and whose surface fixed to the back surface of the fixation film is flat.

2. A key sheet according to claim 1, further comprising an adhesion layer provided on the back surface of each of the key tops and used to intimately fix the entire back surface thereof to the fixation film.

3. A key sheet according to claim 1, wherein the base sheet has a mounting portion for effecting its mounting with the back surface thereof spaced apart from the front surface of the printed circuit board, and wherein the base sheet undergoes curving deformation through depressing operation on the key tops using the mounting portion as a fulcrum free from being displaced in the depressing direction for effecting depression input through the contact switch, with the base sheet being restored to the original configuration by canceling the depressing operation.

4. A key sheet according to claim 1, wherein the base sheet has an elastic covering portion made of a rubber-like elastic material and covering at least one of the front surface and the back surface of the reinforcing member, and wherein the elastic covering portion undergoes compressing deformation through depressing operation on the key tops for effecting depression input through the contact switch, with the base sheet being restored to the original configuration by canceling the depressing operation.

5. A key sheet according to claim 1, wherein the adhesion layer is an adhesion layer that is softened or melted by heating.

6. A key sheet according to claim 1, wherein the fixation film is formed of a soft resin.

7. A key sheet according to claim 1, wherein the fixation film is formed of a thermoplastic resin.

8. A key seat according to claim 1, wherein the key top is formed of a hard resin selected from the group consisting of a polycarbonate resin, a polymethylmethacrylate resin, a polypropylene resin, a polystyrene resin, a polyacryl copolymer resin, a polyolefin resin, an acrylonitrile butadiene styrene resin, a polyester resin, an epoxy resin, a polyurethane resin, a polyamide resin, and a silicone resin;

wherein the fixing film is formed of one of a thermoplastic resin and a flexible resin selected from the group consisting of a polyamide resin, a polyurethane resin, and a polyvinyl chloride resin; and wherein the base sheet is formed of:

the reinforcing component formed of one of: a hard resin selected from the group consisting of a polycarbonate resin, a polymethylmetacrylate resin, a polypropylene resin, a polystyrene resin, a polyacryl copolymer resin, a polyolefin resin, an acrylonitrile butadiene styrene resin, a polyester resin, an epoxy resin, a polyurethane resin, a polyamide resin, and a silicone resin; and a metal; and the rubber sheet formed of a rubber-like material which is made of any one of a rubber and a thermoplastic elastomer.

9. A key sheet according to claim 1, wherein the reinforcing member has a through-hole extending through the thickness thereof.

10. A pushbutton switch having a key sheet and a board within a casing, wherein the key sheet comprises a key sheet according to any one of claims 1 through 9, and wherein a fixation film and a base sheet of the key sheet are fixed in a pressurized state between the casing and the board.

* * * * *